US011384472B2

(12) United States Patent
Seo et al.

(10) Patent No.: US 11,384,472 B2
(45) Date of Patent: Jul. 12, 2022

(54) WASHING MACHINE HAVING DETERGENT SUPPLY DEVICE

(71) Applicant: SAMSUNG ELECTRONICS CO., LTD., Suwon-si (KR)

(72) Inventors: Dong-Pil Seo, Hwaseong-si (KR); Sang Up Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 260 days.

(21) Appl. No.: 16/757,977

(22) PCT Filed: Sep. 4, 2018

(86) PCT No.: PCT/KR2018/010265
§ 371 (c)(1),
(2) Date: Apr. 21, 2020

(87) PCT Pub. No.: WO2019/083152
PCT Pub. Date: May 2, 2019

(65) Prior Publication Data

US 2020/0370230 A1 Nov. 26, 2020

(30) Foreign Application Priority Data

Oct. 24, 2017 (KR) ..... 10-2017-0138284

(51) Int. Cl.
*D06F 39/02* (2006.01)
*D06F 39/08* (2006.01)

(52) U.S. Cl.
CPC ..... *D06F 39/02* (2013.01); *D06F 39/028* (2013.01); *D06F 39/08* (2013.01)

(58) Field of Classification Search
CPC ..... D06F 39/02
See application file for complete search history.

(56) References Cited

U.S. PATENT DOCUMENTS

2004/0172770 A1 9/2004 Heo et al.
2008/0229517 A1 9/2008 Amarillas et al.
(Continued)

FOREIGN PATENT DOCUMENTS

CN 1516764 A 7/2004
CN 103850096 A 6/2014
(Continued)

OTHER PUBLICATIONS

International Search Report dated Jan. 15, 2019, in corresponding International Patent Application No. PCT/KR2018/010265.
(Continued)

*Primary Examiner* — Jason Y Ko
(74) *Attorney, Agent, or Firm* — Staas & Halsey LLP

(57) ABSTRACT

Provided is a washing machine having a detergent supply device in which water supplied to the detergent supply device is evenly distributed in a detergent case so that detergent remaining in the detergent case is washed out completely. The detergent supply device includes a housing having an opening, a detergent case coupled to be movable through the opening and provided with a detergent accommodating part in which a detergent is accommodated, and a water supply unit coupled to the housing and configured to guide water to the detergent case, wherein the water supply unit includes: a first water supply frame provided with a first water supply channel that guides water to a first area corresponding to the detergent accommodating part; and a second water supply frame provided with a second water supply channel that guides water to a second area having at least a portion located outside a circumference of the first area.

11 Claims, 12 Drawing Sheets

(56) References Cited

U.S. PATENT DOCUMENTS

| | | | |
|---|---|---|---|
| 2010/0175435 | A1 | 7/2010 | Shin et al. |
| 2014/0157835 | A1 | 6/2014 | Del Pos et al. |

FOREIGN PATENT DOCUMENTS

| | | | |
|---|---|---|---|
| CN | 106536811 | A | 3/2017 |
| CN | 107012666 | A | 8/2017 |
| JP | 2016-168130 | | 9/2016 |
| KR | 10-2007-0059426 | | 6/2007 |
| KR | 10-1252158 | | 4/2013 |
| KR | 10-2013-0125199 | | 11/2013 |
| KR | 10-2014-0027849 | | 3/2014 |
| KR | 10-2015-0135043 | | 12/2015 |

OTHER PUBLICATIONS

Extended European Search Report dated Jun. 9, 2020 in European Patent Application No. 18871188.1.

Korean Office Action dated Dec. 15, 2021 in Korean Application No. 10-2017-0138284 (7 pages; 12 pages English translation).

Chinese Office Action dated May 11, 2022 in Chinese Patent Application No. 201880069431.X (7 pages; 7 pages English translation).

WASHING MACHINE HAVING DETERGENT SUPPLY DEVICE

CROSS-REFERENCE TO RELATED APPLICATIONS

This application is a U.S. National Stage Application which claims the benefit under 35 U.S.C. § 371 of International Patent Application No. PCT/KR2018/010265 filed on Sep. 4, 2018, which claims foreign priority benefit under 35 U.S.C. § 119 of Korean Patent Application No. 10-2017-0138284 filed on Oct. 24, 2017 in the Korean Intellectual Property Office, the contents of both of which are incorporated herein by reference.

TECHNICAL FIELD

The disclosure relates to a washing machine, and more specifically, to a washing machine having a detergent supply device.

BACKGROUND ART

A washing machine is an appliance that washes clothes using electric power. In general, a washing machine includes a tub to store wash water, a drum rotatably mounted in the tub, a pulsator rotatably mounted on a bottom of the drum, and a motor to rotate the drum and the pulsator.

After laundry and detergent water are put in the drum, the drum and the pulsator are rotated by the motor, and the pulsator stirs the laundry placed in the drum together with the wash water to remove the dirt from the laundry.

In general, a detergent supply device of a drum washing machine includes a detergent case serving to accommodate a solid detergent and a liquid detergent and a water supply unit to supply water to the detergent case.

As for the detergent case into which a detergent is introduced, detergents may not be washed away depending on the water pressure of the corresponding place or the water temperature. In general, the detergent may not be washed away in a part having a slow flow rate of water or a part not easily reached by the supplied water. The residual detergent when continuously exposed to low temperature water may be hardened. The hardened detergent may not be washed away even when the water pressure is increased, which leads to the rinsing performance being lowered in a rinsing process following the washing process, or customer dissatisfaction after the rinsing process.

DISCLOSURE

Technical Problem

Therefore, it is an object of the disclosure to provide a washing machine having an improved structure for a detergent supply device in which water supplied to the detergent supply device is evenly distributed in a detergent case.

It is another object of the disclosure to provide a washing machine having an improved structure for a detergent supply device in which a one-direction rotational water current is generated inside a detergent case by water sprayed from a plurality of spray nozzles.

It is another object of the disclosure to provide a washing machine having an improved structure for a detergent supply device in which a detergent is prevented from remaining in a detergent case regardless of the water pressure or the water temperature. Additional aspects of the disclosure will be set forth in part in the description which follows and, in part, will be obvious from the description, or may be learned by practice of the disclosure.

According to an aspect of the present invention, there is provided a detergent supply device including: a housing having an opening; a detergent case coupled to be movable through the opening and provided with a detergent accommodating part in which a detergent is accommodated; and a water supply unit coupled to the housing to guide water to the detergent case, wherein the water supply unit includes: a first water supply frame provided with a first water supply channel that guides water to a first area corresponding to the detergent accommodating part; and a second water supply frame provided with a second water supply channel that guides water to a second area having at least a portion located outside a circumference of the first area.

The second water supply frame may be arranged below the first water supply frame.

The first water supply frame may include a plurality of spray nozzles arranged in the first area of the detergent case and configured to form a one-directional rotational water current by sprayed water.

The plurality of spray nozzles may protrude downward from the first water supply frame while having an inclination.

The detergent case may include a rotating member coupled to be rotatable to dissolve a detergent in the detergent accommodating part in water.

The plurality of spray nozzles may be arranged to form a rotational water current in a rotation direction of the rotating member.

The water supply frame may include a first supply pipe configured to supply water to the first water supply channel and a second supply pipe configured to supply water to the second water supply channel, wherein the first supply pipe and the second supply pipe alternately supply water.

The second water supply frame may include a plurality of water supply holes such that water flowing through the second water supply channel is sprayed to the second area.

A number of the water supply holes may be more than a number of the plurality of spray nozzles.

The first water supply frame may include a communication hole that allows the first water supply frame to communicate with the second water supply frame, and may include a second water supply channel forming rib connecting the second water supply pipe to the communication hole to guide water supplied through the communication hole to the second water supply channel.

The first water supply frame may include a first water supply forming rib that forms the first water supply channel.

According to another aspect of the present invention, there is provided a washing machine including: a main body; a drum rotatably provided inside the main body; and a detergent supply device provided in the main body and configured to supply a detergent into the drum, wherein the detergent supply device includes: a detergent case provided with a detergent accommodating part in which a detergent is accommodated; a rotating member rotatably mounted on the detergent accommodating part; and a water supply frame configured to supply water to the detergent accommodating part, wherein the water supply frame includes: a plurality of spray nozzles configured to form a one-direction rotational water current by water sprayed into the detergent accommodating part; and a plurality of water supply holes configured to guide water to correspond to an outer circumference of the detergent accommodating part.

The plurality of spray nozzles may protrude downward from the first water supply frame while having an inclination.

The plurality of spray nozzles may be arranged to form a rotational water current in a rotation direction of the rotating member.

The detergent supply device may include: a first supply pipe configured to supply water to a first area corresponding to the detergent accommodating part; and a second supply pipe configured to supply water to a second area corresponding to an outer circumference of the detergent accommodating part, wherein the first supply pipe and the second supply pipe alternately supply water.

A number of the water supply holes may be more than a number of the plurality of spray nozzles.

The water supply frame may include a first water supply frame configured to guide water to the first area and a second water supply frame arranged below the first water supply frame and configured to guide water to the second area.

The first water supply frame may include a first water supply channel forming rib connecting the first supply pipe to the plurality of spray nozzles to form the first water supply channel.

The first water supply frame may include a communication hole that allows the first water supply frame to communicate with the second water supply frame, and include a second water supply channel forming rib connecting the second water supply pipe to the communication hole to guide water supplied through the communication hole to the second water supply channel.

The water supply device may include a cover coupled to an upper portion of the first water supply frame.

Advantageous Effects

As is apparent from the above, the water supplied to the detergent supply device is evenly distributed in the detergent case, so that the detergent in the detergent case can be washed out completely.

In addition, the detergent can be prevented from remaining irrespective of the water pressure or the water temperature, thereby eliminating the consumer's concern about the residual detergent.

In addition, the water sprayed from the plurality of spray nozzles generates a one-direction rotational water current in the detergent case, and the water is evenly scattered throughout the detergent case, so that the detergent case is maintained to be clean.

DESCRIPTION OF DRAWINGS

These and/or other aspects of the invention will become apparent and more readily appreciated from the following description of the embodiments, taken in conjunction with the accompanying drawings of which.

MODES OF THE INVENTION

Hereinafter, embodiment of the disclosure will be described with reference to the accompanying drawings. The terms "front", "rear", "upper", "lower", "top", and "bottom" as herein used are defined with respect to the drawings, but the terms may not restrict the shape and position of the respective components.

Figure 1:
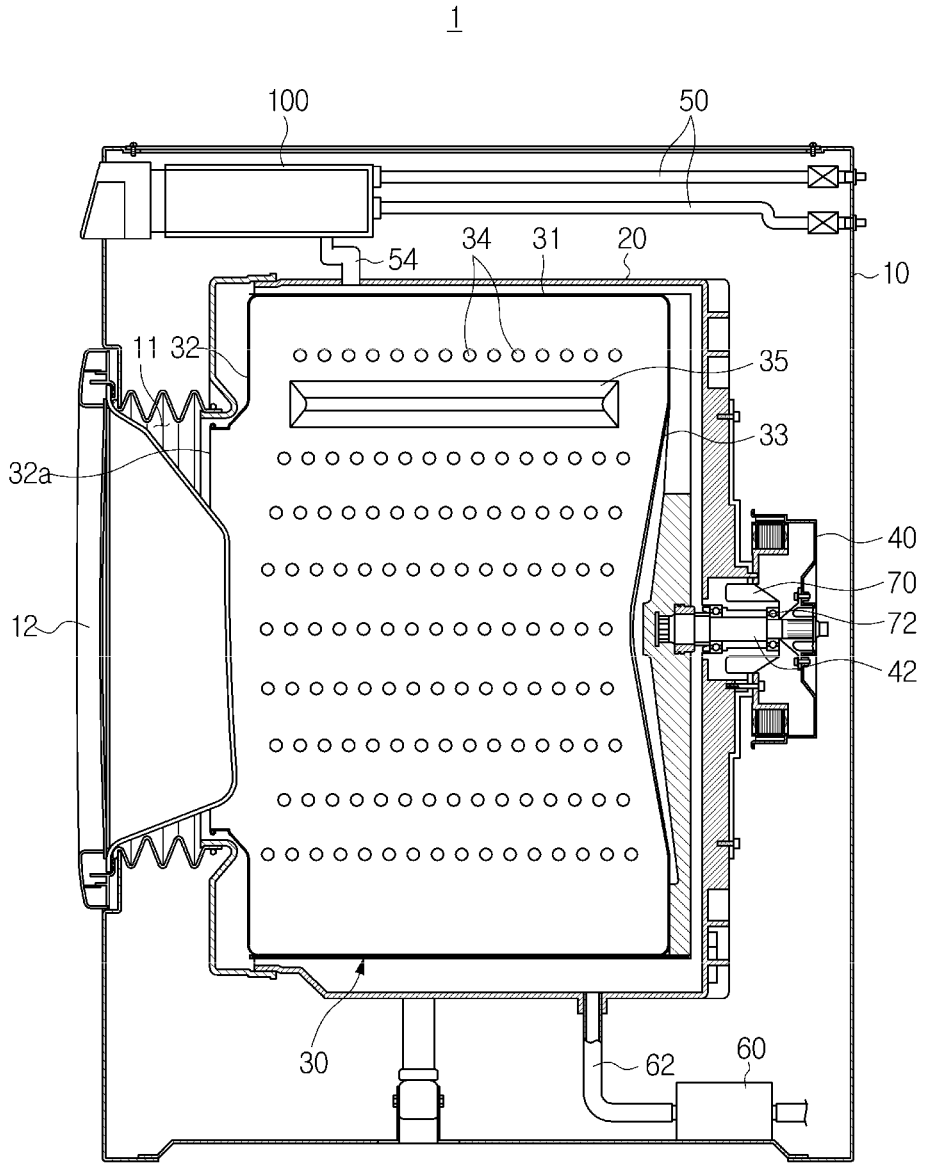
FIG. 1 is a view illustrating the configuration of a washing machine equipped with a detergent supply device according to an embodiment of the disclosure.

FIG. 1 is a view illustrating the configuration of a washing machine 1 equipped with a detergent supply device according to an embodiment of the disclosure.

Referring to FIG. 1, the washing machine 1 includes a main body 10 defining the external appearance thereof and supporting various components therein, a tub 20 arranged in the main body 10, a drum 30 rotatably arranged in the tub 20, and a motor 40 to drive the drum 30.

The main body 10 is formed with an entrance hole 11 at a front surface thereof, through which laundry is introduced into the drum 30. The entrance hole 11 may be opened or closed by a door 12 mounted on the front surface of the main body 10.

A water supply pipe 50 to supply wash water to the tub 20 is mounted above the tub 20. The water supply pipe 50 has one side connected to an external water supply source (not shown) and the other side connected to a detergent supply device 100.

The detergent supply device 100 is connected to the tub 20 through a connection pipe 54. The detergent supply device 100 includes a detergent case 120 to accommodate a detergent or a fabric softener. Water supplied through the water supply pipe 50 passes through the detergent case 120 and is mixed with the detergent or the fabric softener so that the water together with the detergent or the fabric softener is supplied into the tub 20.

A water drain pump 60 and a water drain pipe 62 may be installed below the tub 220 to discharge water inside the tub 20 to the outside of the main body 10.

The drum 30 includes a cylindrical body 31, a front plate 32 placed at the front side of the cylindrical body 31, and a rear plate 33 placed at the rear side of the cylindrical body 31. The front plate 32 has an aperture 32*a* for entrance of laundry, and the rear plate 33 may be connected to a drive shaft 42 to transmit the power of the motor 40.

A plurality of through-holes 34 are formed in the circumference of the drum 30. A plurality of lifters 35 are provided at an inner circumferential surface of the drum 30 to raise and drop laundry during rotation of the drum 30.

The drive shaft 42 is arranged between the drum 30 and the motor 40. One end of the drive shaft 42 is connected to the rear plate 33, and the other end of the drive shaft 42 extends outward of a rear wall of the tub 20. When the motor 40 rotates the drive shaft 42, the drum 30 connected to the drive shaft 42 is rotated about the drive shaft 42.

A bearing housing 70 is mounted to the rear wall of the tub 20 to rotatably support the drive shaft 42. The bearing housing 70 may be inserted into the rear wall of the tub 20 during injection molding of the tub 20. Bearings 72 are interposed between the bearing housing 70 and the drive shaft 42, to assure smooth rotation of the drive shaft 42.

Hereinafter, the structure of the detergent supply device 100 according to the embodiment of the disclosure will be described.

Figure 2:
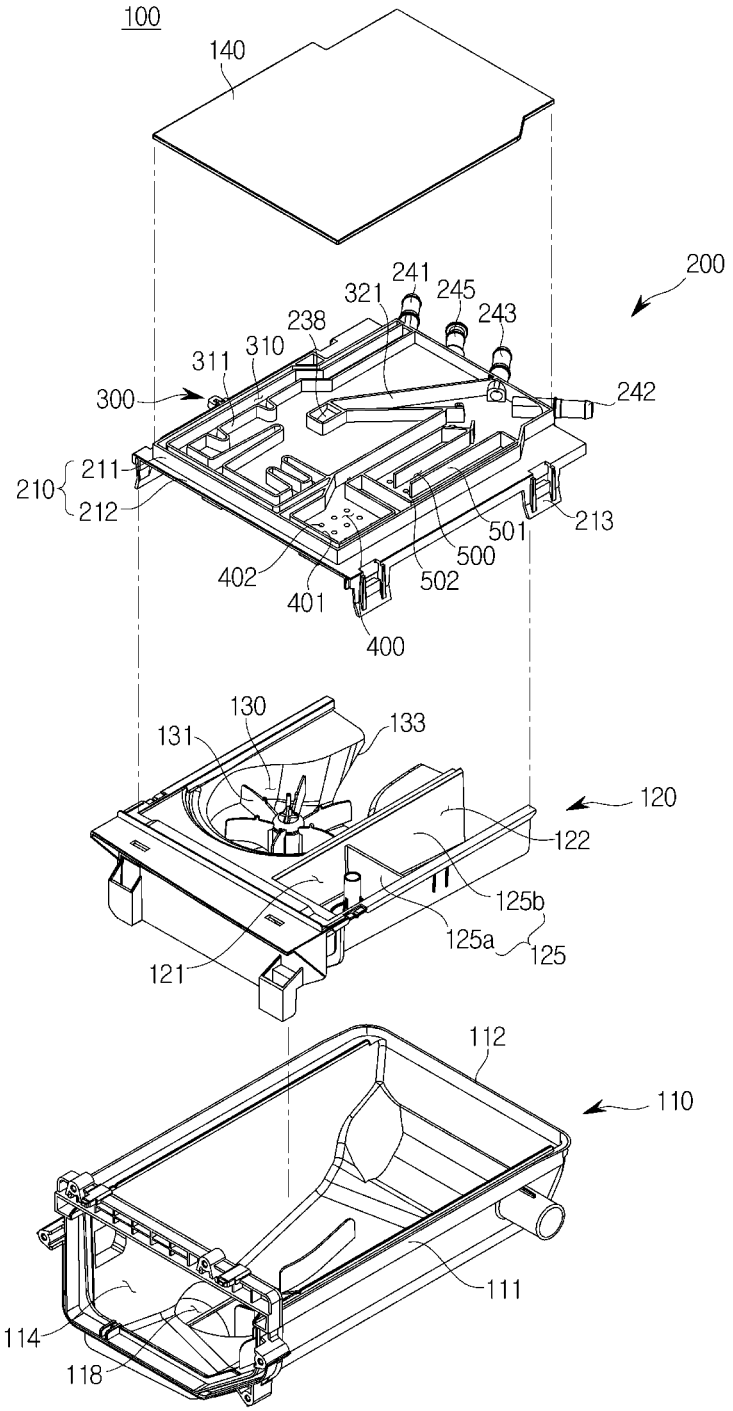
FIG. 2 is an exploded perspective view illustrating a detergent supply device according to an embodiment of the disclosure.
Figure 3:
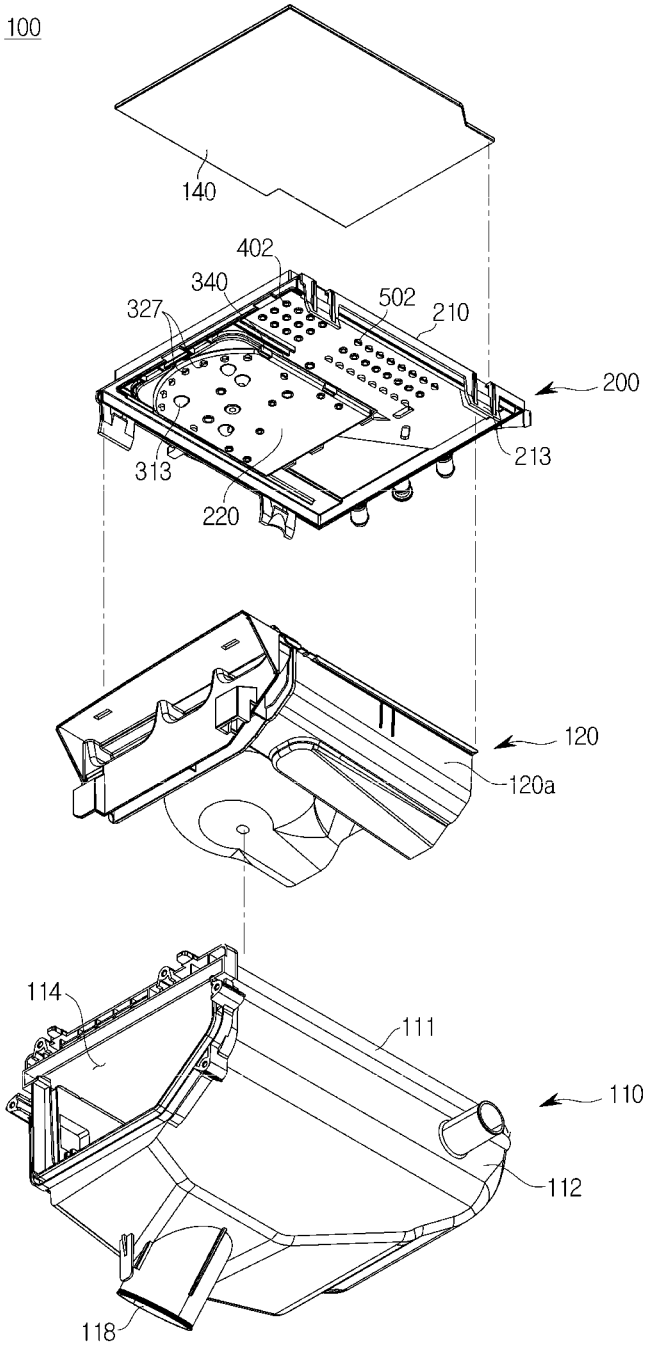
FIG. 3 is an exploded perspective view illustrating the detergent supply device of FIG. 2, which is viewed at another angle.
Figure 4:
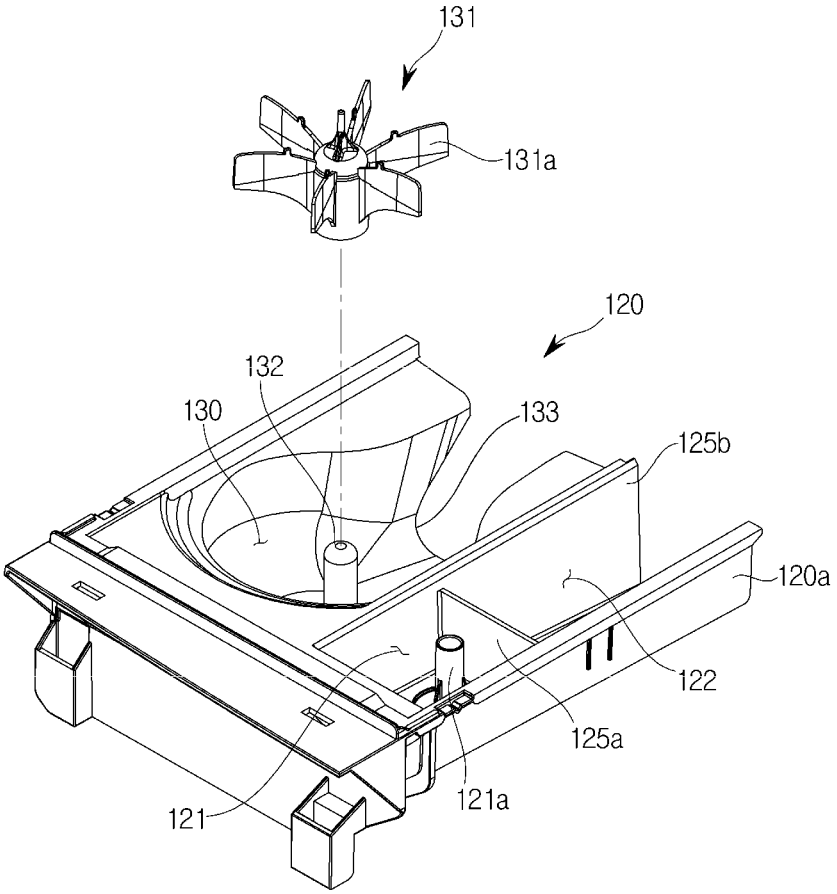
FIG. 4 is a perspective view illustrating a detergent case of a detergent supply device according to an embodiment of the disclosure.
Figure 5:
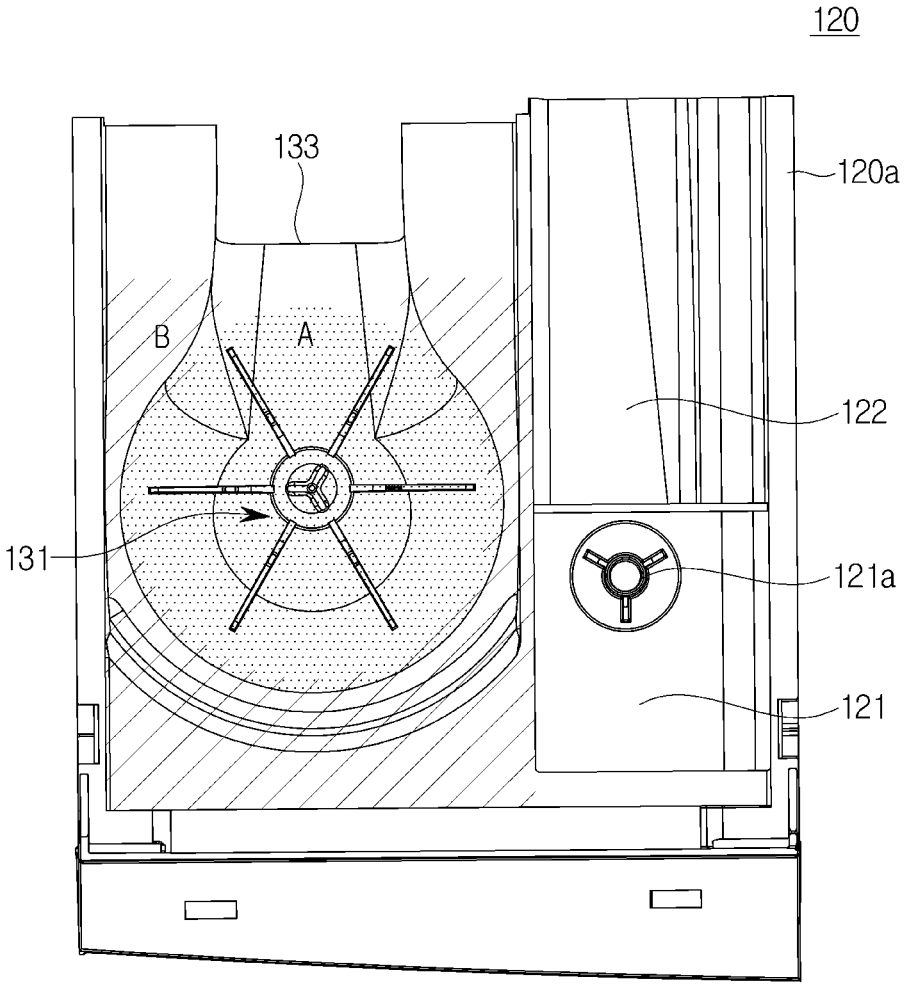
FIG. 5 is a plan view illustrating a detergent case according to an embodiment of the disclosure.
Figure 6:
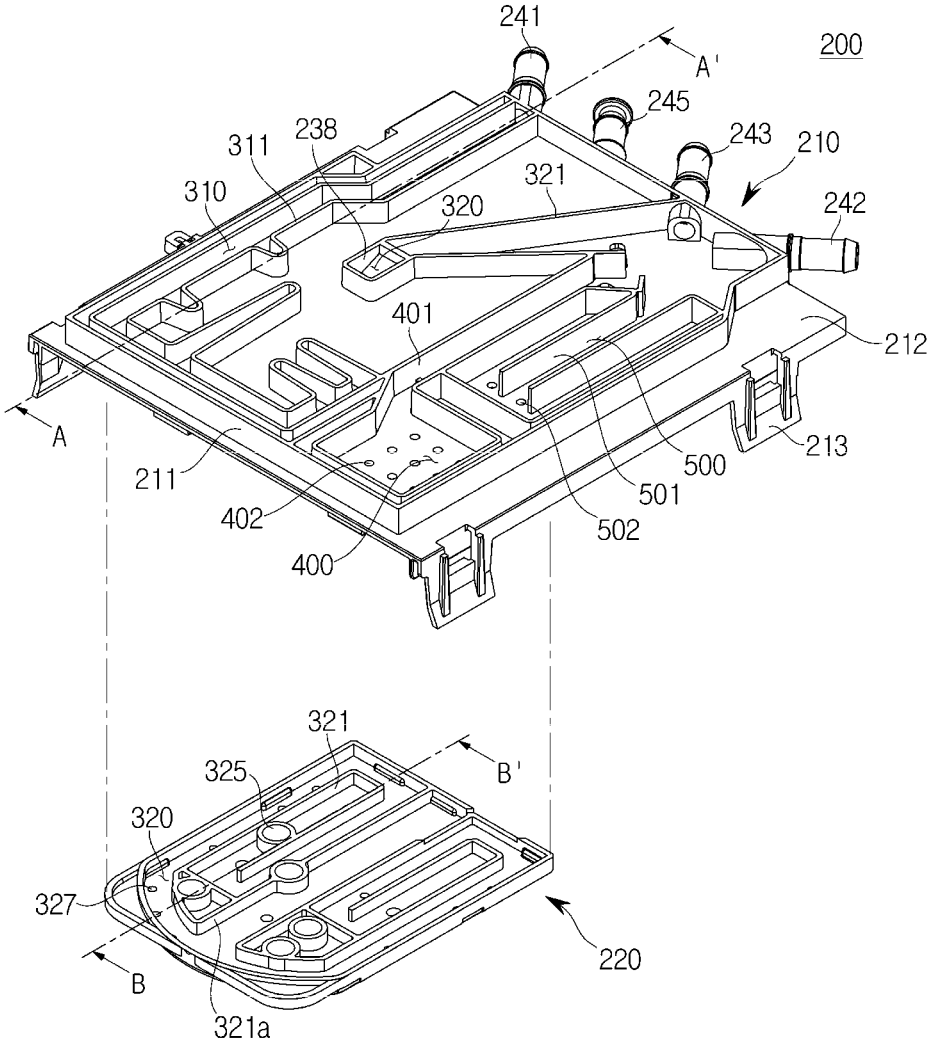
FIG. 6 is an exploded perspective view illustrating a water supply unit of a detergent supply device according to an embodiment of the disclosure.
Figure 7:
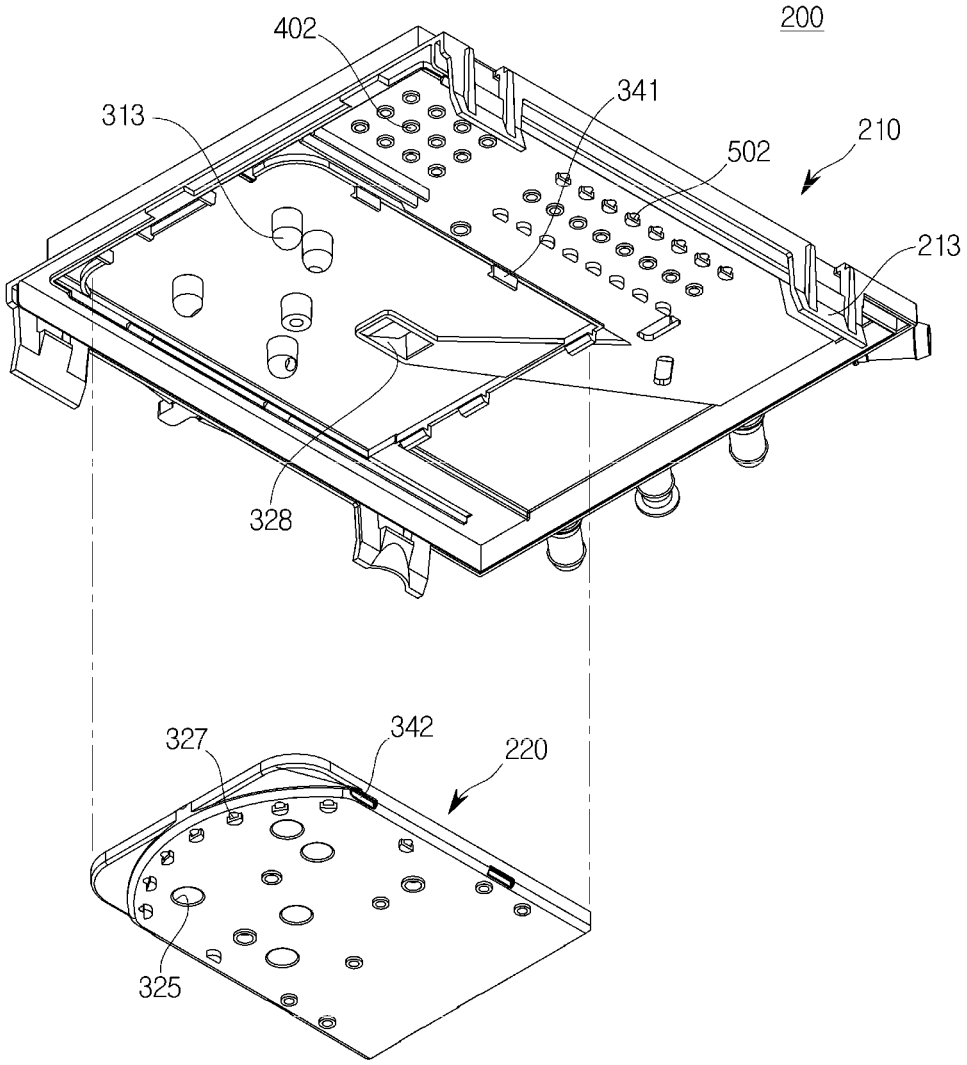
FIG. 7 is a view illustrating a first water supply frame and a second water supply frame according to an embodiment of the disclosure, which is viewed at different angles.
Figure 8:
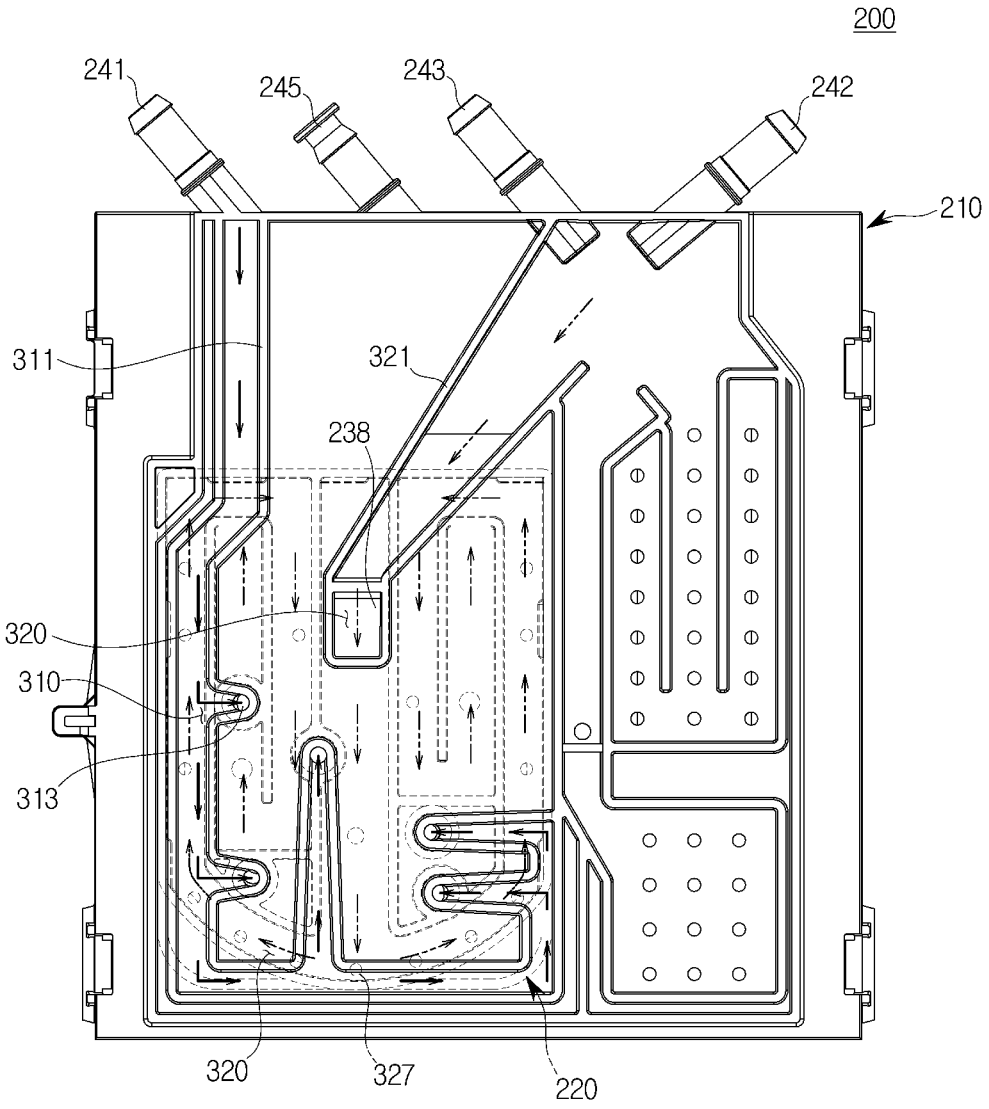
FIG. 8 is a view illustrating a first water supply channel and a second water supply channel of a water supply unit according to an embodiment of the disclosure.
Figure 9:
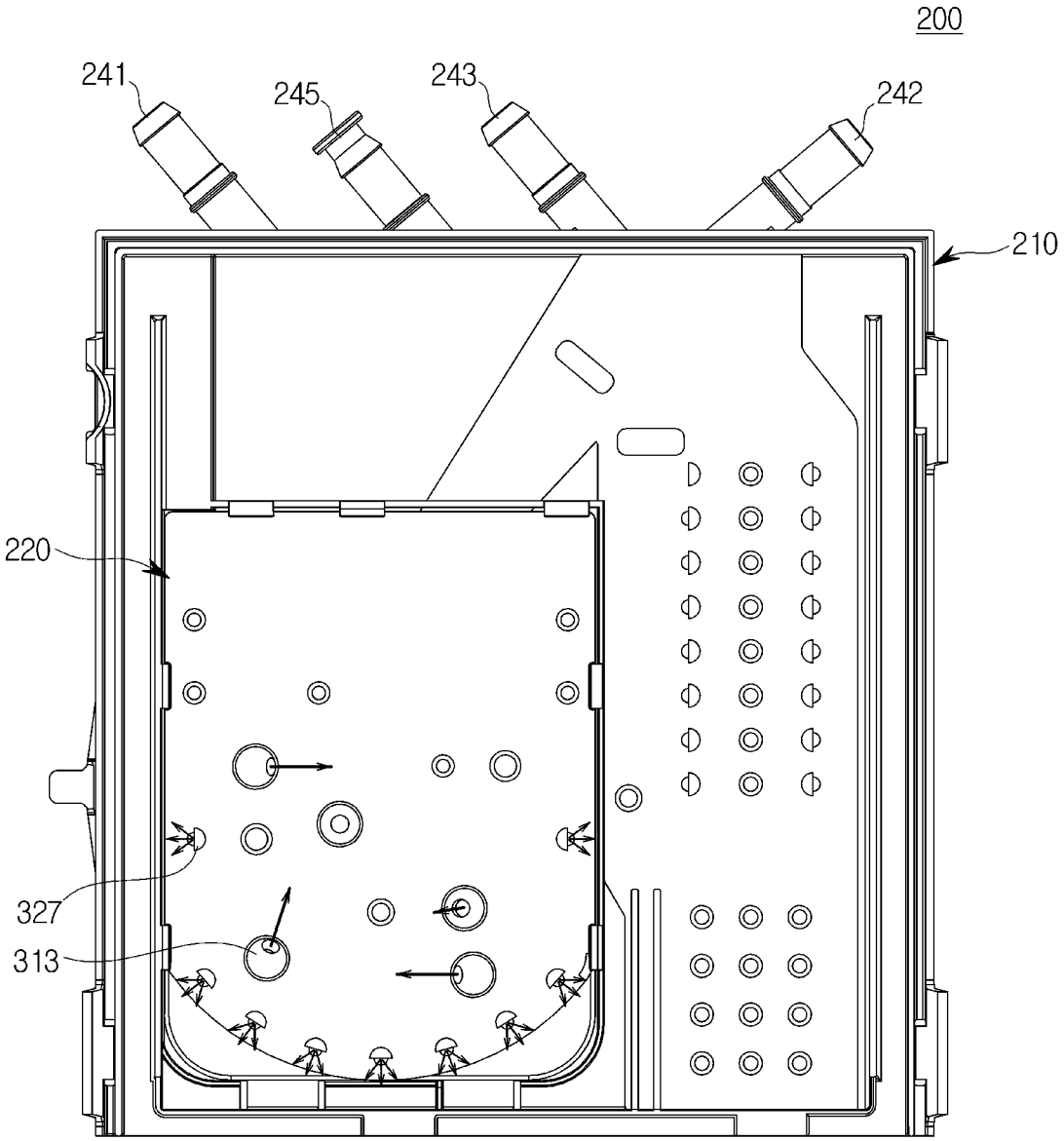
FIG. 9 is a bottom view illustrating a first water supply frame and a second water supply frame according to an embodiment of the disclosure.
Figure 10:
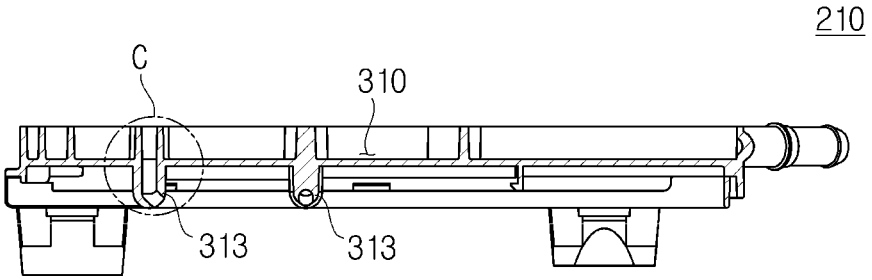
FIG. 10 is a cross-sectional view taken along line A-A of FIG. 6, which shows a first water supply frame according to an embodiment of the disclosure.
Figure 11:
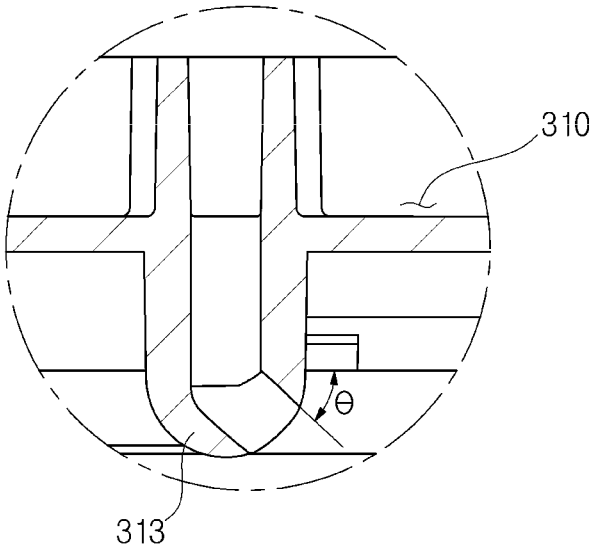
FIG. 11 is an enlarged view of portion C of FIG. 10, which shows a spray nozzle according to an embodiment of the disclosure.
Figure 12:
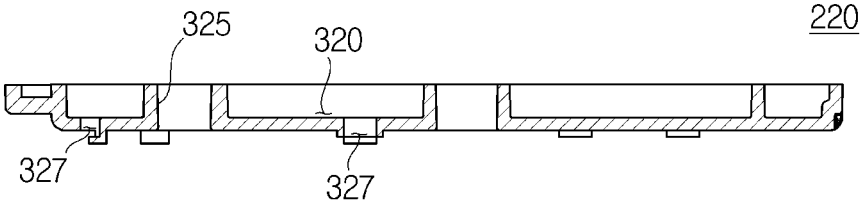
FIG. 12 is a cross-sectional view taken along line B-B of FIG. 6, which shows a second water supply frame according to an embodiment of the disclosure.

FIG. 2 is an exploded perspective view illustrating a detergent supply device according to an embodiment of the disclosure, FIG. 3 is an exploded perspective view illustrating the detergent supply device of FIG. 2, which is viewed at another angle, FIG. 4 is a perspective view illustrating a detergent case of a detergent supply device according to an embodiment of the disclosure, FIG. 5 is a plan view illustrating a detergent case according to an embodiment of the disclosure, FIG. 6 is an exploded perspective view illustrating a water supply unit of a detergent supply device according to an embodiment of the disclosure, FIG. 7 is a view illustrating a first water supply frame and a second water supply frame according to an embodiment of the disclosure, which is viewed at different angles, FIG. 8 is a view illustrating a first water supply channel and a second water supply channel of a water supply unit according to an embodiment of the disclosure, FIG. 9 is a bottom view illustrating a first water supply frame and a second water supply frame according to an embodiment of the disclosure, FIG. 10 is a cross-sectional view taken along line A-A' of FIG. 6, which shows a first water supply frame according to an embodiment of the disclosure, FIG. 11 is an enlarged view of portion C of FIG. 10, which shows a spray nozzle according to an embodiment of the disclosure, and FIG. 12 is a cross-sectional view taken along line B-B' of FIG. 6, which shows a second water supply frame according to an embodiment of the disclosure.

Referring to FIGS. 2 to 12, the detergent supply device 100 includes the detergent supply device 110, a detergent case 120 movably coupled to the housing 110 and accommodating a detergent and a fabric softener, a water supply unit 200 coupled to the upper portion of the housing 110 to supply water, and a cover 140 sealing the water supply unit 200.

The housing 110 includes a housing body 112 in which the detergent case 120 is accommodated, an opening 114 formed at a front portion of the housing body 112 so that the detergent case 120 is withdrawn therethrough, an outlet 118 formed at a lower portion of the housing body 112 to guide the water containing the detergent and the fabric softener to be discharged to the outside of the detergent supply device 100. The outlet 118 is connected to the connection pipe 54, the water containing the detergent and fabric softener discharged through the outlet 118 is supplied into the tub 20 via the connection pipe 54. The lower portion of the housing body 112 is inclined toward the outlet 118 so that the water containing the detergent and the fabric softener may be naturally discharged through the outlet 118 without being accumulated in the housing body 112.

The detergent case 120 is installed to be movable through the opening 114 of the housing 110. The detergent case 120 includes a detergent case body 120*a*, a detergent accommodating part 130 formed inside the detergent case body 120*a*, and a liquid detergent accommodating part 121 and a softener accommodating part 122 partitioned through a partition wall 125.

The detergent accommodating part 130 is provided to accommodate a solid detergent. The liquid detergent accommodating part 121 is divided from the detergent accommodating part 130 through a first partition wall 125*a*. The liquid detergent accommodating part 121 is provided to accommodate a liquid detergent, and includes a siphon tube 121*a* protruding a predetermined length from the bottom of the liquid detergent accommodating part 121 and a siphon cap (not shown) coupled to the outside of the siphon tube 121*a*. The softener accommodating part 122 may be divided from the detergent accommodating part 130 through the first partition wall 125*a* and may be divided from the liquid detergent accommodating part 121 through a second partition 125*b*.

The detergent accommodating part 130 is provided with a rotating member 131 rotatably coupled thereto and dissolve a solid detergent. The detergent accommodating part 130 may have a rotating shaft 132 that is formed in a protruding manner to rotatably support the rotating member 131 thereon. The rotating member 131 may be rotatably installed on the rotating shaft 132 inside the detergent accommodating part 130. The rotating member 131 may include a plurality of blades 131*a*.

Accordingly, the rotating member 131 is supplied with water through the water supply unit 200, which is described below, and as the plurality of vanes 131*a* are rotated around the rotating shaft 132, a vortex is generated, so that the solid detergent inside the detergent accommodating part 130 is dissolved.

The detergent accommodating part 130 is provided at a rear side with a drain part 133 so that the detergent dissolved water is drained. The drain part 133 is formed at the rear end of the detergent accommodating part 130 while sloping downward at a predetermined angle so that the detergent dissolved water moves to the rear side of the detergent accommodating part 130.

On the other hand, the water supply unit 200 disposed on the upper portion of the detergent case 120 includes a plurality of water supply channels 300, 400, and 500 that are provided to move the water supplied from an external water supply source (not shown) to the detergent accommodating part 130, the liquid detergent accommodating part 121, and the softener accommodating part 122 of the detergent case 120, respectively.

The water supply unit 200 may include a plurality of supply pipes 241, 242, and 243 provided to supply water to the plurality of water supply channels 300, 400, and 500. The plurality of supply pipes 241, 242, and 243 may include a first supply pipe 241, a second supply pipe 242, and a third supply pipe 243.

The plurality of water supply channels 300, 400, and 500 include a detergent accommodating part channel 300 arranged above the detergent accommodating part 130 of the detergent case 120 to supply water to the detergent accommodating part 130, a liquid detergent accommodating part channel 400 arranged above the liquid detergent accommodating part 121 of the detergent case 120 to supply water to the liquid detergent accommodating part 121, and a softener accommodating part channel 500 arranged above the softener accommodating part 122 of the detergent case 120 to supply water to the softener accommodating part 122.

Although the first supply pipe 241 and the second supply pipe 242 supply water to the detergent accommodating part channel 300, and the third supply pipe 243 supplies water to the liquid detergent accommodating part channel 400 and the softener accommodating part channel 500 in the embodiment of the disclosure, the disclosure is not limited thereto.

The water supply unit 200 may include a first water supply frame 210 and a second water supply frame 220 arranged below the first water supply frame 210.

The first water supply frame 210 may include a first water supply frame body 211 and a first water supply frame base 212. The first water supply frame base 212 is provided below the first water supply frame body 211. The first water supply frame base 212 may be provided to correspond to the upper portion of the housing 110. A locking protrusion 111 is provided at an outer upper side of the housing 110 to be coupled and fixed to the first water supply frame base 212. At least two fastening hooks 213 may be formed on the first water supply frame base 212. The locking protrusion 111 may be formed at an outer upper circumference of the housing body 112 so as to be caught with the fastening hook 213 of the first water supply frame base 212.

The first water supply frame body 211 is provided above the first water supply frame base 212. The first water supply frame body 211 may be provided with the detergent accommodating part channel 300 for guiding water to the detergent accommodating part 130, a liquid detergent accommodating part channel 400 for guiding water to the liquid detergent accommodating part 121, and the softener accommodating part channel 500 for guiding water to the softener accommodating part 122.

The first water supply frame body 211 may be provided with the first supply pipe 241, the second supply pipe 242, and the third supply pipe 243 for supplying water to the plurality of water supply channels 300, 400, and 500. The first supply pipe 241, the second supply pipe 242, and the third supply pipe 243 may be disposed at a rear side of the first water supply frame body 211. In addition to the plurality of supply pipes 241, 242, and 243, a discharge pipe 243 may be provided at the rear side of the first water supply frame body 211 to discharge water overflowed from the water supply channels 300, 400, and 500.

The first water supply frame body 211 may be provided at an inner side with channel forming ribs 311, 321, 401, and 501 for forming the detergent accommodating part channel 300, the liquid detergent accommodating part channel 400, and the softener accommodating part channel 500.

The first water supply frame body 211 may include a first water supply channel forming rib 311 and a second water supply channel forming rib 321 provided to form a first water supply channel 310 and a second water supply channel 320, which will be described below, to guide the water to the detergent accommodating part 130, and a liquid detergent accommodating part channel forming rib 401 provided to guide the water to the liquid detergent accommodating part channel 400, and a softener accommodating part channel forming rib 501 provided to guide the water to the softener accommodating part channel 500.

The liquid detergent accommodating part channel 400 includes a plurality of liquid detergent accommodating part water supply holes 402 formed at a position corresponding to an upper portion of the liquid detergent accommodating part 121 such that water supplied from the third supply pipe 243 is guided by the liquid detergent accommodating part channel forming rib 401 to the liquid detergent accommodating part 121.

The softener accommodating part channel 500 includes a plurality of softener accommodating part water supply holes 502 formed at a position corresponding to an upper portion of the softener accommodating part 122 such that water supplied from the third supply pipe 243 is guided by the softener accommodating part channel forming rib 501 to the softener accommodating part 122.

On the other hand, the cover 140 may be coupled to the upper portion of the first water supply frame body 211 to seal the water supply unit 200.

The first water supply frame 210 of the water supply unit 200 includes the first water supply channel 310 provided to guide water to a first area A corresponding to the detergent accommodating part 130. The first water supply channel 310 is formed such that water supplied through the first supply pipe 241 is guided through the first water supply channel forming rib 311 to a plurality of spray nozzles 313.

The first water supply frame 210 includes the plurality of spray nozzles 313 disposed in the first area A of the detergent case 120. The plurality of spray nozzles 313 are arranged to form a one-direction rotational water current by the water sprayed into the first area A. The plurality of spray nozzles 313 may be disposed within the first area A of the detergent case 120. The plurality of spray nozzles 313 are formed downward from the first water supply frame 210 while having an angled portion θ. The one-direction rotational water current formed by water supplied through the plurality of spray nozzles 313 may be provided to rotate the rotating member 131. Although the spray nozzles are illustrated as including four spray nozzles in the embodiment of the disclosure, the disclosure is not limited thereto. For example, the number of spray nozzles may be equal to or greater than four, or equal to or less than four.

The second water supply frame 220 may be disposed below the first water supply frame 210. The second water supply frame 220 is disposed and installed at a lower side of the first water supply frame 210 corresponding to the detergent accommodating part 130. The second water supply frame 220 is coupled to the first water supply frame 210 by a coupling part 340. The first water supply frame 210 is provided with at least one coupling protrusion 341 for coupling with the second water supply frame 220. The second water supply frame 220 is provided at both sides with coupling grooves 342 corresponding to the coupling protrusion 341.

The second water supply frame 220 may include a second water supply channel 320 that guides water to a second area B whose at least a portion is located outside the circumference of the first area A. Although the second area B is illustrated as being located outside the circumference of the first area A in the embodiment of the disclosure, the disclosure is not limited thereto. For example, at least a portion of the second area may overlap the first area.

The second water supply channel 320 is formed such that the water supplied through the second supply pipe 242 is guided through the second water supply channel forming rib 321 to be moved to a plurality of water supply holes 327. The plurality of water supply holes 327 may be formed to correspond to the upper portion of the second area B of the detergent case 120.

The second water supply channel forming rib 321 may connect the second supply pipe 242 of the first water supply frame 210 to a communication hole 238. The communication hole 238 allows the first water supply frame 210 to communicate with the second water supply frame 220 so as to transfer water supplied to the first supply pipe 241 to the second water supply frame 220. The communication hole 238 is formed in the first water supply frame 210.

The water supplied through the communication hole 238 passes through the plurality of water supply holes 327 of the second water supply channel 320 formed in the second water supply frame 220 and is guided to the second area B of the detergent case 120.

The second water supply channel forming rib 321 may be formed to guide the water guided through the communication hole 238 to the plurality of water supply holes 327 of the second water supply frame 220.

The second water supply frame 220 may include a spray nozzle installation part 325 through which the plurality of spray nozzles 313 of the first water supply frame 210 passes to be installed. The spray nozzle installation part 325 may be formed to correspond to the plurality of spray nozzles 313 of the first water supply frame 210. The spray nozzle installation part 325 may be disposed in the first area A of the detergent case 120.

Meanwhile, the number of the plurality of water supply holes 327 formed in the second water supply channel 320 is more than the number of the plurality of spray nozzles 313 of the first water supply channel 310. For example, the plurality of spray nozzles 313 may be provided as four spray nozzles, and the plurality of water supply holes 327 may be provided as four or more water supply holes. Such a difference in number between the plurality of spray nozzles 313 and the plurality of water supply holes 327 may cause a difference in the water pressure between the first water supply channel 310 and the second water supply channel 320.

Therefore, the water supplied through the first supply pipe 241 guides water to the first area A of the detergent accommodating part 130 at a relatively high-water pressure through the four spray nozzles 313. The four spray nozzles 313 form a rotational water current in one direction. When the rotating member 131 is rotated by the one-direction rotational water current formed by the spray nozzles 313, detergent and water are splashed to the outside of the detergent accommodating part 130, that is, to the second area B through the high water pressure and the plurality of blades 131*a*.

In this case, the water supplied through the second supply pipe 242 guides water to the second area B of the detergent accommodating part 130 at a relatively low water pressure through the plurality of water supply holes 327. The water guided to the second area B through the plurality of water supply holes 327 may guide detergent and water of the second area B into the detergent accommodating part 130.

Water alternately supplied by each of the first supply pipe 241 and the second supply pipe 242 moves to a corresponding one of the first water supply channel 310 and the second water supply channel 320.

Water moved through the first water supply channel 310 is guided to the first area A of the detergent accommodating part 130 through the plurality of spray nozzles 313, and forms a one-direction rotational water current in the detergent accommodating part 130 through the plurality of spray nozzles 313. At this time, the water and the detergent splashing to the outside of the detergent accommodating part 130, that is, to the second area B is guided to the detergent accommodating part 130 through the plurality of water supply holes 327 by the water moved to the second water supply channel 320 through the second supply pipe 242.

As such, the water is guided to the first area A and the second area B of the detergent accommodating part 130 through the first water supply channel 310 and the second water supply channel 320, so that detergent is prevented from remaining in the detergent accommodating part 130.

In addition, since water is scattered to the first and second areas A and B of the detergent accommodating part 130 while being evenly sprayed on the entire detergent case 120, the cleanness of the detergent case 120 may be maintained.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

The invention claimed is:

1. A detergent supply device comprising:

a housing having an opening;

a detergent case coupled to be movable through the opening and provided with a detergent accommodating part in which a detergent is accommodated; and a water supply unit coupled to the housing to guide water to the detergent case, wherein the water supply unit comprises:

a first water supply frame provided with a first water supply channel that guides water to a first area corresponding to the detergent accommodating part; and a second water supply frame provided with a second water supply channel that guides water to a second area having at least a portion located outside a circumference of the first area.

2. The detergent supply device of claim 1, wherein the second water supply frame is arranged below the first water supply frame.

3. The detergent supply device of claim 1, wherein the first water supply frame includes a plurality of spray nozzles arranged in the first area of the detergent case and configured to form a one-directional rotational water current by sprayed water.

4. The detergent supply device of claim 3, wherein the plurality of spray nozzles protrudes downward from the first water supply frame while having an inclination.

5. The detergent supply device of claim 4, wherein the detergent case includes a rotating member coupled to be rotatable to dissolve a detergent in the detergent accommodating part in water.

6. The detergent supply device of claim 5, wherein the plurality of spray nozzles are arranged to form a rotational water current in a rotation direction of the rotating member.

7. The detergent supply device of claim 3, wherein the water supply frame includes a first supply pipe configured to supply water to the first water supply channel and a second supply pipe configured to supply water to the second water supply channel, wherein the first supply pipe and the second supply pipe alternately supply water.

8. The detergent supply device of claim 3, wherein the second water supply frame includes a plurality of water supply holes such that water flowing through the second water supply channel is sprayed to the second area.

9. The detergent supply device of claim 8, wherein a number of the water supply holes is more than a number of the plurality of spray nozzles.

10. The detergent supply device of claim 7, wherein the first water supply frame includes a communication hole that allows the first water supply frame to communicate with the second water supply frame, and includes a second water supply channel forming rib connecting the second water supply pipe to the communication hole to guide water supplied through the communication hole to the second water supply channel.

11. The detergent supply device of claim 7, wherein the first water supply frame includes a first water supply forming rib that forms the first water supply channel.

* * * * *